US008801285B1

(12) United States Patent
Schnaars, Sr.

(10) Patent No.: US 8,801,285 B1
(45) Date of Patent: Aug. 12, 2014

(54) BULK BAG LIFTING LOOP ATTACHMENT SYSTEM

(75) Inventor: Daniel R. Schnaars, Sr., Lafayette, LA (US)

(73) Assignee: Ameriglobe, LLC, Lafayette, LA (US)

( * ) Notice: Subject to any disclaimer, the term of this patent is extended or adjusted under 35 U.S.C. 154(b) by 310 days.

(21) Appl. No.: 12/604,458

(22) Filed: Oct. 23, 2009

Related U.S. Application Data

(60) Provisional application No. 61/108,113, filed on Oct. 24, 2008.

(51) Int. Cl.
*B65D 33/06* (2006.01)

(52) U.S. Cl.
USPC ..... 383/6; 363/17; 363/119

(58) Field of Classification Search
CPC ..... B65D 88/26; B65D 88/28; B65D 88/30; B65D 88/32; B65D 88/16; B65D 88/1606; B65D 88/1612; B65D 88/1618; B65D 88/1625; B65D 88/1631; B65D 88/1637; B65D 88/1643; B65D 88/1656; B65D 88/1668; B65D 88/1675; B65D 88/1681; B65D 88/1687
USPC ..... 383/6, 17, 20, 24, 32, 15, 18, 19, 903, 383/22, 36, 105, 107, 119, 120, 907
See application file for complete search history.

(56) References Cited

U.S. PATENT DOCUMENTS

| | | | | | |
|---|---|---|---|---|---|
| 4,010,784 | A * | 3/1977 | Nattrass et al. | ..... | 383/17 |
| 4,207,937 | A * | 6/1980 | Sandeman et al. | ..... | 383/17 |
| 4,300,608 | A * | 11/1981 | Cuthbertson | ..... | 383/7 |
| 4,301,848 | A * | 11/1981 | Beaven et al. | ..... | 383/20 |
| 4,362,199 | A * | 12/1982 | Futerman | ..... | 383/17 |
| 4,457,456 | A * | 7/1984 | Derby et al. | ..... | 222/105 |
| 4,499,599 | A * | 2/1985 | Polett et al. | ..... | 383/6 |
| 5,203,633 | A * | 4/1993 | Derby | ..... | 383/17 |
| 5,244,280 | A * | 9/1993 | Porter et al. | ..... | 383/17 |
| 5,695,286 | A * | 12/1997 | Williamson et al. | ..... | 383/24 |
| 2003/0235350 | A1 * | 12/2003 | Richardson et al. | ..... | 383/24 |
| 2008/0101730 | A1 * | 5/2008 | Schnaars et al. | ..... | 383/32 |

FOREIGN PATENT DOCUMENTS

| | | | | | |
|---|---|---|---|---|---|
| GB | 2184422 | A * | 6/1987 | ..... | B65D 33/02 |
| WO | WO 9737908 | A1 * | 10/1997 | ..... | B65D 88/16 |

* cited by examiner

*Primary Examiner* — Jes F Pascua
*Assistant Examiner* — Nina Attel
(74) *Attorney, Agent, or Firm* — Garvey, Smith, Nehrbass & North, L.L.C.; Gregory C. Smith; Julia M. FitzPatrick

(57) ABSTRACT

An improved bulkbag and method of making same, of the type having four sidewalls, a floor and top portion, all portions stitched together to define the enclosure for the bulk bag housing material. The bag comprises a plurality of four wall panels, which each panel having a first and second vertical edge for sewing into the next adjacent panel along each edge. Prior to sewing the panels together, to each upper edge of each panel there is provided a first and second leg of a lifting loop, so that each loop spans from the first edge to the second edge of each panel. The panels are then sewn together along their edges, and there is defined the bulk bag, with the ends of each of the four lifting loops terminating at the stitch line between panels, which define the middle of each sidewall of the bag. There would then be provided a reinforcement ring at each point where a pair of legs of lifting loops are stitched to strengthen the attachment point. Further there would be provided at each lifting loop attachment points a dart, or stacker seam to define the bottleneck feature of the bag. The lifting loop attachment points would define a vertical seam along the surface of the dart defined by the stacker seam. Further there is provided a back tack stitching feature to prevent spread forces in the filled bag, and reinforcing strapping in the loops to provide a stiffening feature to the loops.

8 Claims, 6 Drawing Sheets

35
33
11
32
37
11
34

35
33
11
34
37
32
11
45

100
11
11
37
34
32

30
30
10
100
11
11
45

BULK BAG LIFTING LOOP ATTACHMENT SYSTEM

CROSS-REFERENCE TO RELATED APPLICATIONS

Priority of U.S. Provisional Patent Application Ser. No. 61/108,113, filed Oct. 24, 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The system of the present invention relates to bulk bags. More particularly the present invention relates to the attachment of lifting loops of bulk bags, along either the bag corners or along the central portion of each side wall in combination with a bottleneck bag feature for allowing greater and more secure stackability of the filled bags.

2. General Background

Bulk bags have been in use for over 30 years in the package industry. The original concept of bulk bags was to create a package that can carry ½ ton to 2 tons of dry flowable products by mechanical means from one factory to another.

While every bag has been designed to safely carry the weight upon four lifting loops built into the top of the bag, the vast majority of bags are shipped upon wood pallets. This has increased the cost of using these bags significantly.

Essentially this has been done in order to speed up the process of picking up the bag for transport. The loops on the top of bulk bags are undependable in position and too small to allow forklift drivers quick and easy access. Almost all current bulk bag designs require the forklift operator to stop and physically place the loops onto the forklift tines or, alternatively, have a second person standing by to place the loops as the operator drives forward.

In the issue of stacking and unstacking bulk bags more safely, the prior art basically reduces all the lifting safety into equal amounts in each corner. That amount is basically ¼ of the total. This is true because each loop is only attached to ¼ of the lifting power of the bag.

In the unstacking process in the current state of the art, it is very difficult for the fork lift operator to see all four loops. The higher the stack, the greater the vision impairment and the greater the chance that the operator will fail to get all four loops. This problem is further aggravated by the fact that the two rear loops are horizontally 36 inches behind the front loops. The front of an elevated bag can completely hide the fork operator's vision of those rear positioned loops.

When this is added to the small target that is also poorly supported and may not be standing up at all, it is easy to see that this method of retrieval is discouraging and unworkable in the present art.

As an alternative to wood pallets, there are two very important features which are addressed. The first is the manner in which the filled bulk bag, which may weigh two or more tons, is lifted from one point to another. The second important feature is whether the filled bulk bags may be stacked firmly and securely upon one other so as to allow more filled bags to be placed in a storage or transport space.

There have been many patents granted on these features of bulk bags over the years. In fact, the present inventor has numerous patents relating to bulk bags, and currently has a patent pending on an improved means for filling a bulk bag so that the bag remains stationary, and the side walls remain, completely upright, as the filled bags are stacked upon one another. However, as is usually the case, there is room for improvement in the combination of the lifting loop attachment coupled with the bottleneck feature of the bag so as to have both easy transport of the filled bags, and secure stackability of the bags, which this invention addresses.

The current invention resolves this issue in a unique manner. Each lifting loop has been designed to reach across large portions of the bag instead of starting and stopping within a single corner of the bag. This provides the fork lift operator with a very large target for easy engagement of the lifting loops.

SUMMARY OF THE PRESENT INVENTION

The present invention solves the problems in the art in a simple and straightforward manner. What is provided is a bulkbag, of the type having four sidewalls, a floor and top portion, all portions stitched together to define the enclosure for the bulk bag housing material. The bag comprises a plurality of four wall panels, which each panel having a first and second vertical edge for sewing into the next adjacent panel along each edge. Prior to sewing the panels together, to each upper edge of each panel there is provided a first and second leg of a lifting loop, so that each loop spans from the first edge to the second edge of each panel. The panels are then sewn together along their edges, and there is defined the bulk bag, with the ends of each of the four lifting loops terminating at the sew line between panels, which may positioned at each bag corner, or in the alternative, in the middle of each sidewall of the bag. There would then be provided a reinforcement ring at each point where a pair of legs of lifting loops are stitched to strengthen the attachment point.

Further there would be provided at each lifting loop attachment points a dart, or stacker seam to define the bottleneck feature of the bag, as disclosed in pending regular U.S. patent application, entitled "Improved Design For Stabilizing Fabric Bulk Bags", Ser. No. 11/379,436, by the same inventor, incorporated hereinto fully by reference. The lifting loop attachment points would define a vertical seam along the surface of the dart defined by the stacker seam. Further there is provided a back tack stitching feature to prevent spread forces in the filled bag.

Therefore, it is a principal object of the present invention to provide a bulk bag that is more resistant to failure when picked up by less than four loops;

It is a further principal object to provide a bulk bag which allows a forklift operator to be able to view the loops of the bag when bags are stacked and to more easily hit the "target" with the tynes of the forklift.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Figure 1:
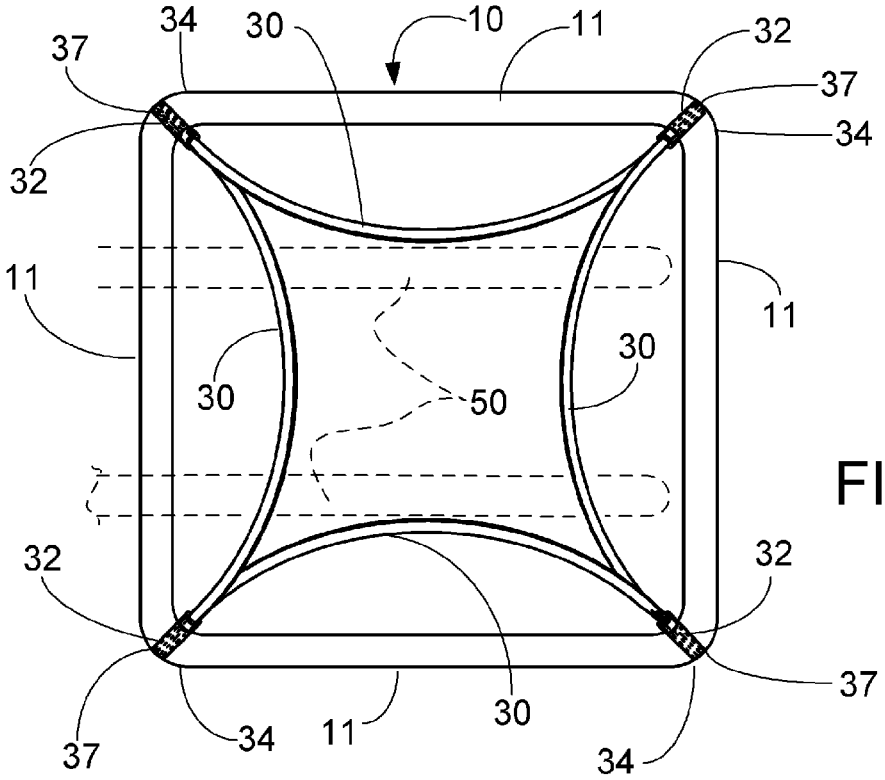
FIG. 1 illustrates a top view of the preferred embodiment of the present invention.
Figure 2:
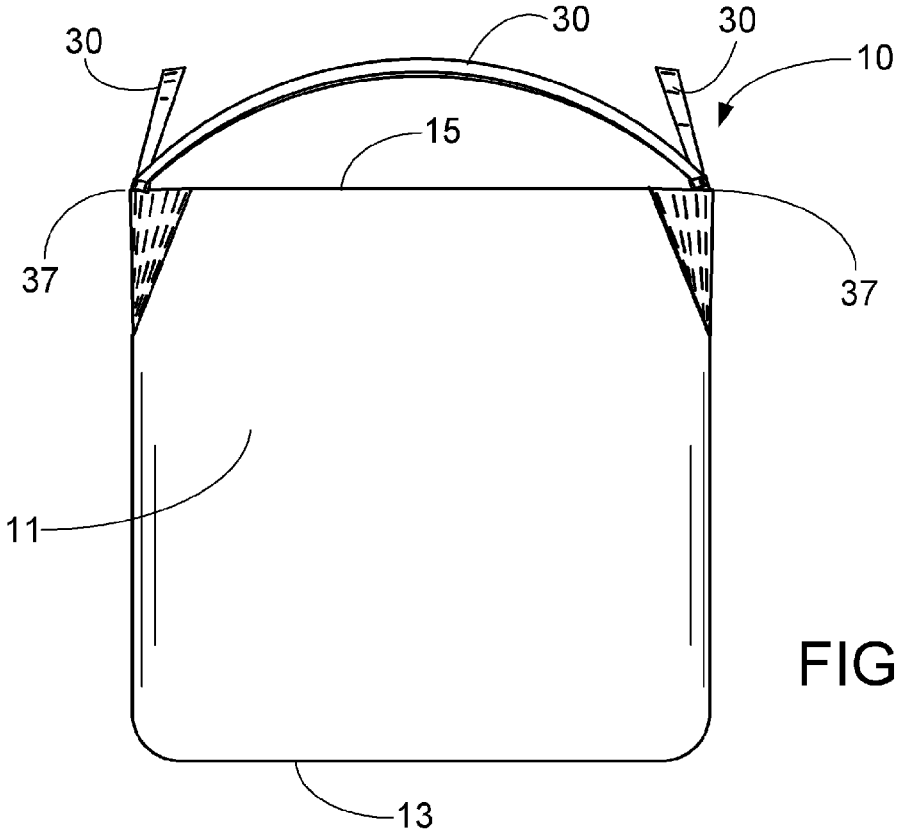
FIG. 2 illustrates a side view thereof.
Figure 3:
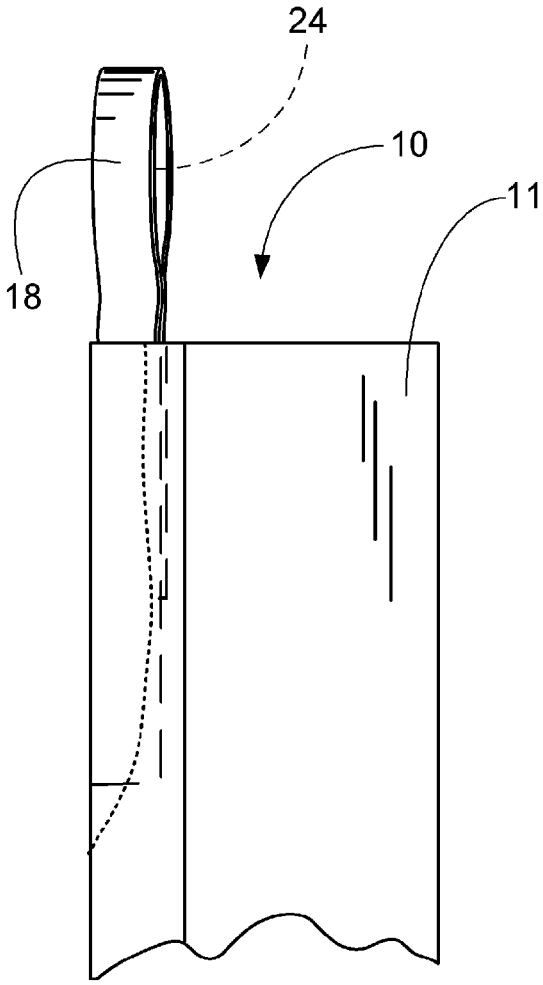
FIG. 3 Prior Art
FIGS. 3 and 4 illustrate side views of the prior art attachment points of lifting loops to bulk bags.
Figure 4:
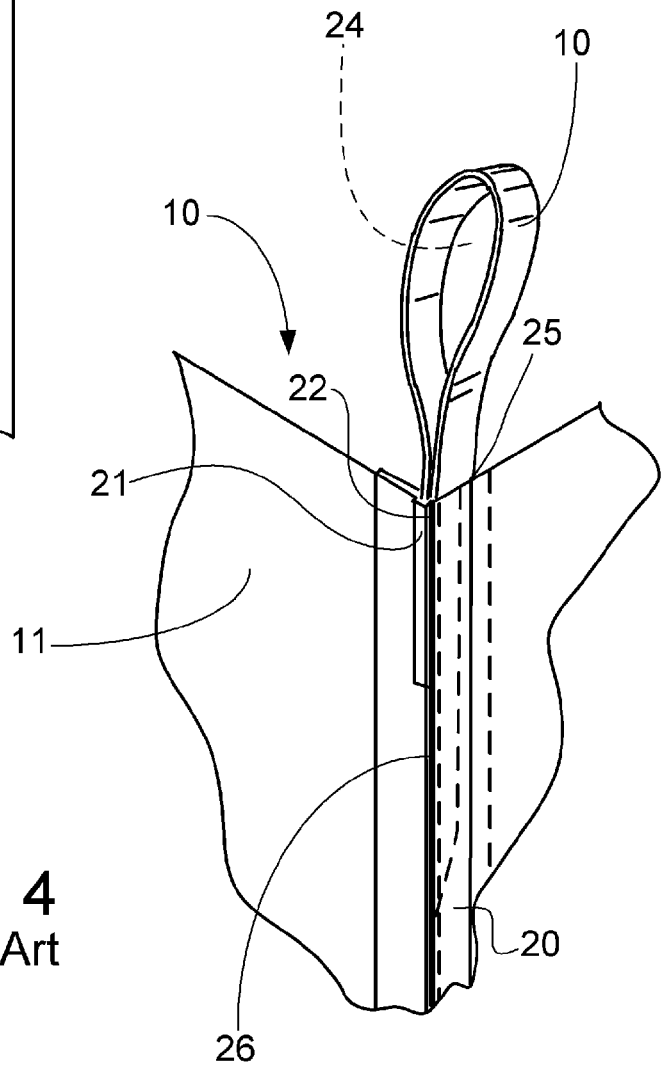
FIG. 4 Prior Art

FIGS. 1 and 2, and 4 through 11 illustrate the preferred embodiment of the bulk bag lifting loop attachment system of the present invention, while FIGS. 3 and 4, labeled "Prior Art" illustrate the conventional attachment points used in bulk bags.

Prior to a discussion of the present invention, reference is made to the prior art conventional attachments as illustrated in FIGS. 3 and 4. First, there is provided in the Figures a pair of bulk bag sidewall panels 11 joined at a vertical seam, with a conventional lifting loop 18, having a pair of legs 20,21 attached to one of the panels 12 via stitching along points 22. There is defined a lifting loop opening 24 through which a forklift tine would enter. In this manner each corner would have a lifting loop 18 so there would be defined a series of four lifting loops 18 of the bulk bag 10. In some cases, the conventional lifting loop 18 would legs 20 and 21 attached approximately five inches from the corner 25 of the vertical seam 26 of each of the adjoining panels 12 which define the sidewalls. In this manner there is defined a larger opening 24 through which a tine of a forklift would enter. There would be included four of these types of loops attached to the corners.

In the manner of attachment as seen in FIGS. 3 and 4, the lifting loop 18 would have serious shortcomings. First, the opening 24 through which the tines of a forklift would enter are quite small and become a difficult target. Moreover, because of the fabric of which the loops 18 are made, the loops 18 would normally be laying of their side, and would require a person to place the loop 18 upright so that the fork lift operator could stab through the loops. Such a method is both time consuming and labor intensive.

Figure 8:
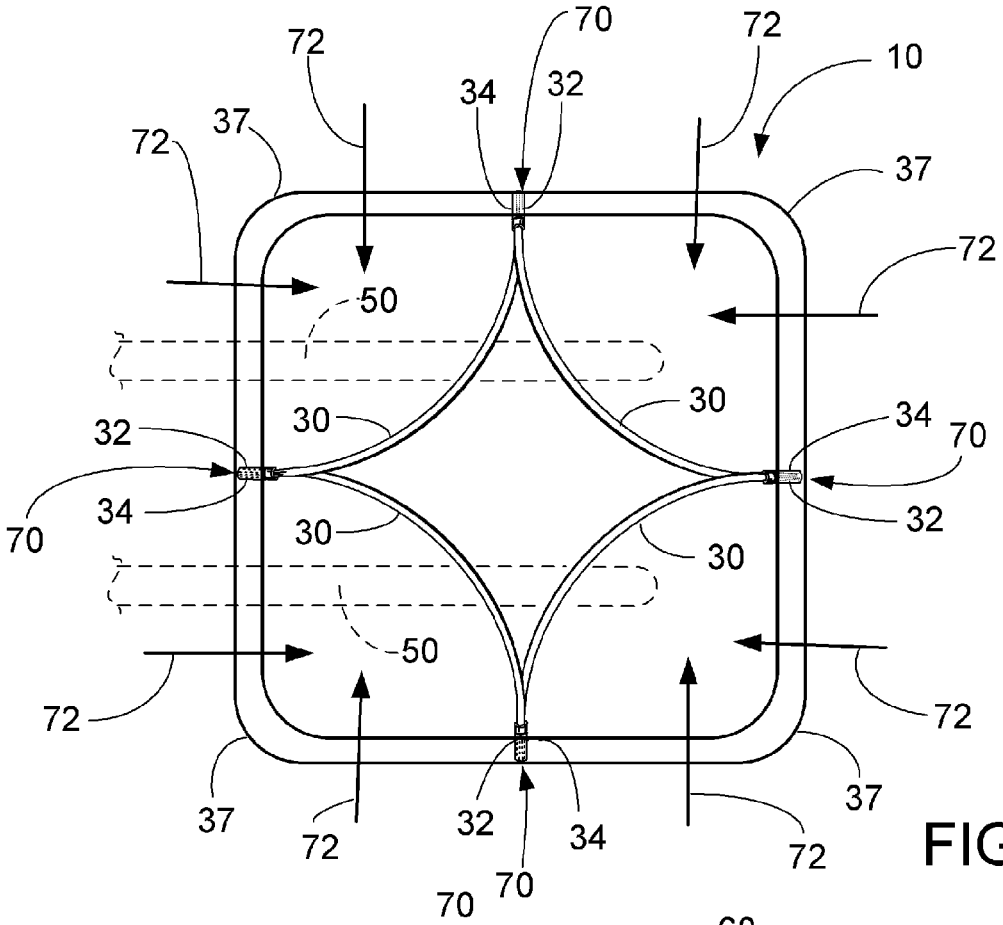
FIGS. 8 and 9 illustrate top and side views respectively of the second principal embodiment of the present invention.

Turning now to the present invention in FIGS. 1 and 2, there is illustrated a first principal embodiment an easy lifting loop 30 of the present invention. As seen there is illustrated a bulk bag 10, having four sidewalls 11, a bottom portion 13, a top portion 15, with each of the sidewalls 11 including first and second edges 32, 34 which are stitched together in their construction. This can be clearly seen in the figures, where there is included a first rectangular side wall panel 11, having a pair of vertical edges 32 and 34, together with a lifting loop 30. In the construction of the bag at each of the corners 37, a first end 33 of a first lifting loop 30 and a second end 35 of a second adjoining lifting loop 30 is stitched between the edges 32, 34 of the wall panel 11. The other ends of the lifting loops 30 are attached in the same manner at the next corner 37 of the bag 10, and this is repeated at all four corners 37 to confect the configuration of lifting loops 30 as seen in top view in FIG. 1. Further, as seen in FIG. 1, referring to the phantom forks 50, it is clear that the operator's view is enhanced by the forward lean of the loops 30. The forklift does not need to reach the back in order to safely lift the bag 10. This is true based on the loops 30 originating from the centers 70 of the sides as seen in FIG. 8, and/or the combination of the EZ Loop and the Stacker.

Figures 5A, 5B, 5C, 5D:
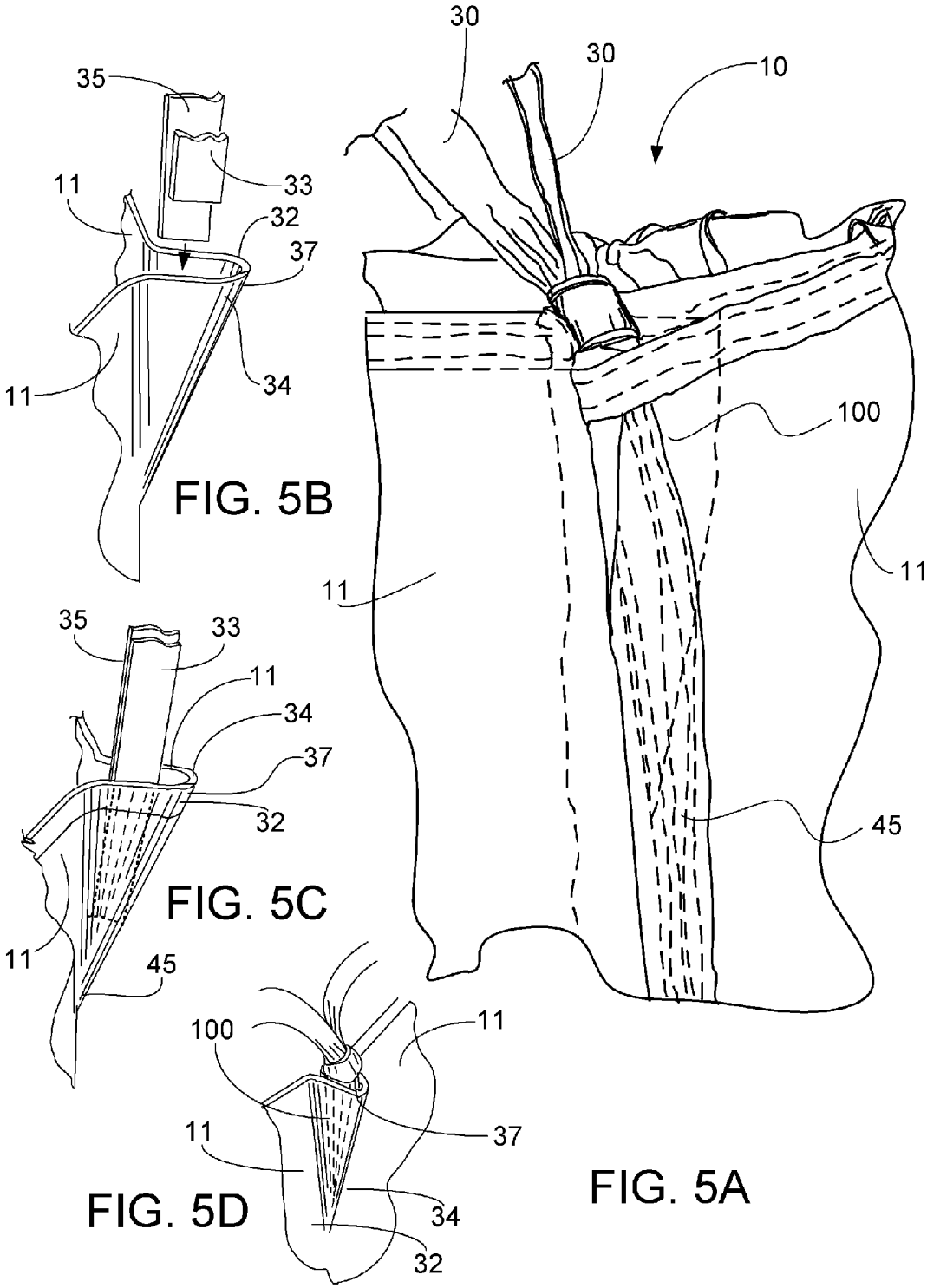
FIG. 5A though 5D illustrate an overall side view of the method of the attachment of the lifting loops to the bulk bag sidewalls, together with the safety enforcement ring and dart feature of the bag.

As seen clearly in FIGS. 5A though 5D, there is illustrated the manner in which the ends or legs 33, 35 of the lifting loops 30 are attached at the four corners 37 of the bag 10 in the preferred embodiment, as seen in FIGS. 1 and 2, so as to provide a strong attachment points in the bag. First, two side walls 11 of the bag 10 are positioned together at their vertical edges 32, 34, and a first end 33 of a lifting loop 30, and a second end of an adjacent lifting loop 30 are inserted into an opening 39 as formed between the edges 32, 34 of two adjoining side walls 11. At this point, as seen in FIG. 5C, the two ends 33, 35 of the two lifting loops 30 are then stitched in between each of the edges 32, 34 of the side walls 11 so that there is a single line of stitching 45 along the corner 37 of the bag 10, which incorporates the stitching of the lifting loops 30 into the walls 11 of the bag 10 therein. An overall view of this arrangement is seen in FIG. 5A, where the ends or legs 33, 35 of the lifting loops 30 are inserted into the dart or stacker seam 100, formed on the corner 37 of the bag 10. Dart or stacker seam 100 has been disclosed and claimed in U.S. patent application Ser. No. 11/379,436, presently pending by the same inventor, and incorporated by reference herein. The stitching line 45 would continue throughout the length of the adjoining side walls 11.

Returning now to FIG. 1, in particular, when this stitching of the lifting loop ends 33, 35 is completed, it is clear that each of the lifting loops 30 span across the width of a side wall 11 and then are engaged and stitched into place at the four corners 37 of the bag 10, which forms that lifting loop pattern seen in FIG. 1, which is quite novel over the prior art. When this occurs, as seen in FIG. 1, the tines 50 (phantom view) of a forklift may be inserted into the openings 60 formed by the manner in which the lifting loops 30 are attached, so as to make it easier for a forklift operator to stab through the large openings 60 formed in the lifting loops 30, as opposed to the prior art fashion.

Figure 6:
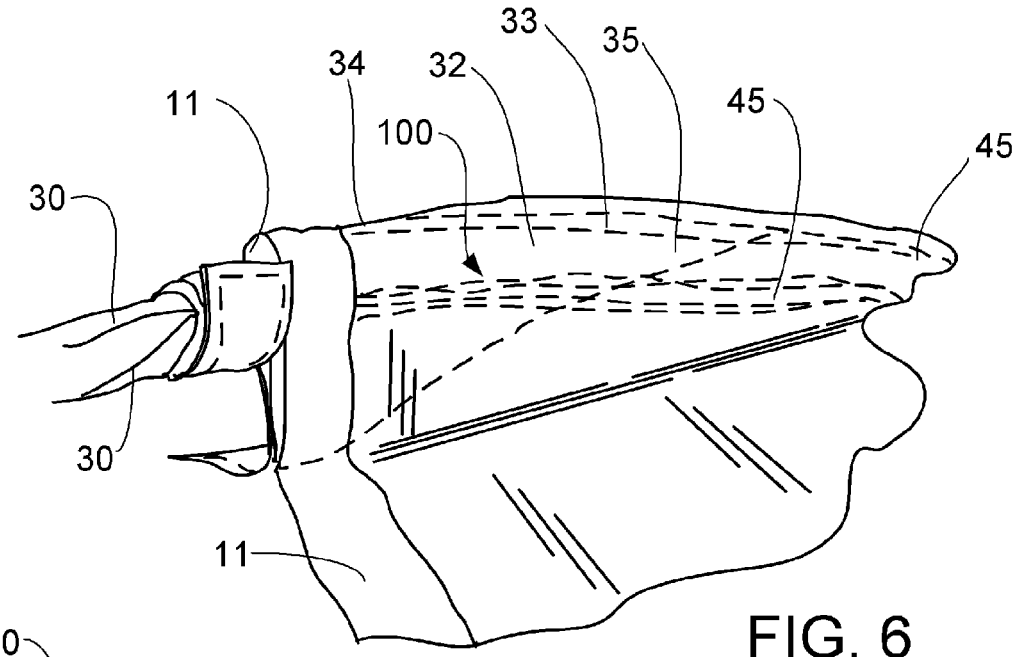
FIG. 6 illustrates an additional view of the features of the bag as illustrated in FIG. 5.
Figure 7:
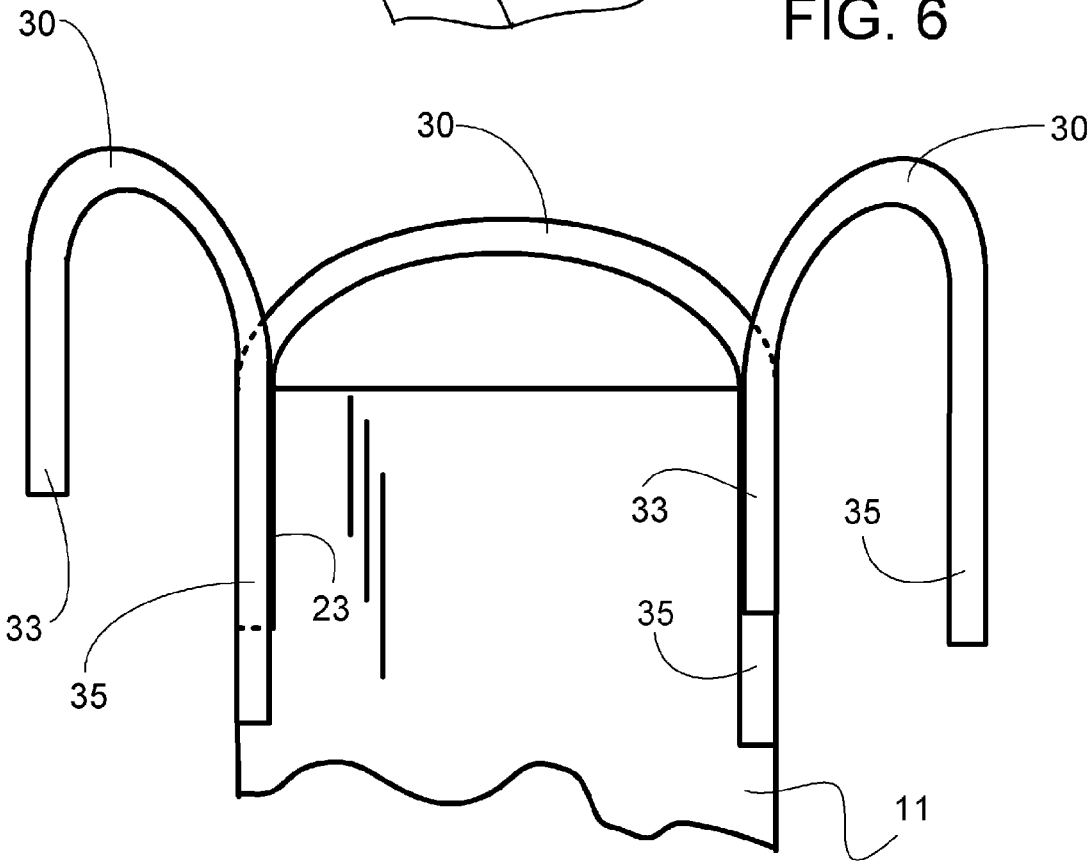
FIG. 7 illustrates a representational view of the lifting loop as it relates to the attachment to the side walls of the bulk bag.

For an additional view of the corner feature of the lifting loops 30 stitched between the edges 32, 34 of each of the side walls 11, reference is made to FIG. 6 where there is seen an additional view of this configuration. In FIG. 7, this provides a representational view of ends 33, 35 of the lifting loops 30 as they span across the width of the bag, and are ready to be sewn into place between the side edges 32, 34 of each of the adjoining side walls 11 of the bag 10. It should be noted for sake of illustration that one leg 33 of a lifting loop 30 is quite longer than the second leg 35 of the loop 30 as you span the width of the bag 10. This would produce the result that at each adjoining sidewall 11, at least one leg of a lifting loop 30 would be a long leg 33, and the other leg would be a short leg 35, which would provide more stitching points along its length to provide greater stability and strength to the lifting of the bag.

Figure 9:
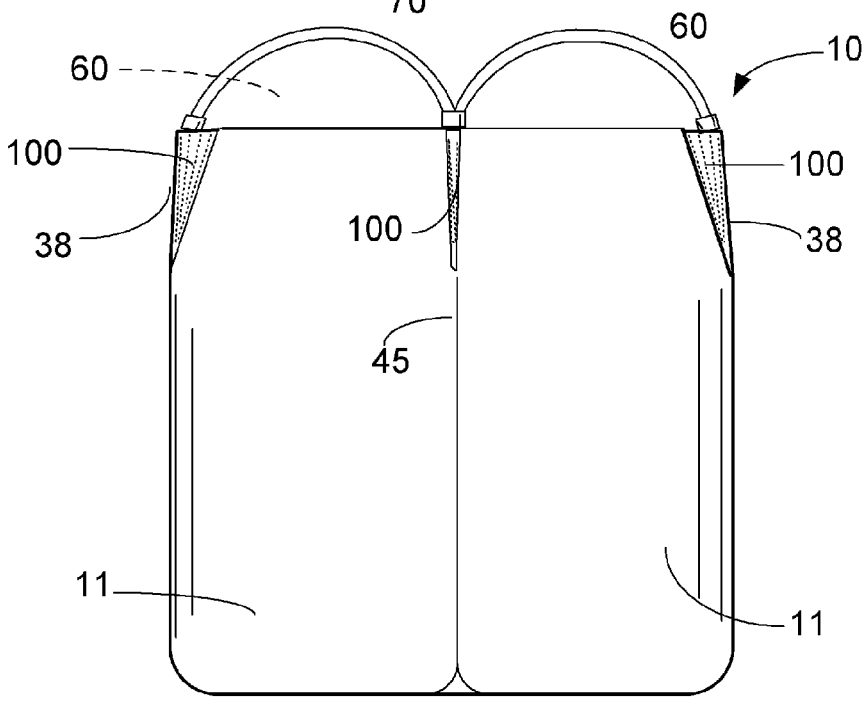

FIGS. 8 and 9 illustrate side and top views respectively of yet a second preferred embodiment of the present invention. The manner in which the lifting loops 30 are attached between the side walls 11 of the bag 10 is exactly in the same manner as described earlier in relation to FIGS. 1 and 2 and FIGS. 5A through 7. However, it should be noted, particularly in top view in FIG. 9, that the ends 33, 35 of the lifting loops 30 do not terminate at the four corners 37 of the bag 10, as seen in top view in FIG. 1. In the second embodiment in FIG. 8, the end points 33, 35 of the lifting loops 30 are secured to the bag 10 between the edges 32, 34 of each of the side walls 11 of the bag 10 along a center point 70 of each of the walls 11 of the bag 10. In other words, each of the four corners 37 of the bag, as seen in FIG. 8, have no stitch points, and the configured bag 10, of the position seen in FIG. 1, in effect has been rotated so that the lifting loop 30 attachment seams 45 are situated along the mid point 70 of each of the walls 11. As seen in top view in FIG. 9, the manner in which the four lifting loops are configured, with the lifting loops 30 spanning over the corners 37 of the bag, would allow the tines 50 (phantom view) of a forklift to be stabbed through the openings 60 from just about any direction (arrows 72) in order to stab through at least two of the loops 30 for lifting the bag. This eliminates a forklift having to come through a particular directional point in order to lift the bag.

For purposes of construction, it should be noted that although the lifting loops 30 are made from a standard fabric, each of the lifting loops may be provided with a "stiffener," within the fabric loop. This "stiffener" would provide support to the loop 30 when the lifting loops are spanning across the width of the bag, they are maintained in the upright position. It is foreseen that the means by which the lifting loops 30 are stiffened, so they are maintained upright as the loops criss-cross from midpoints 70 of adjoining sidewalls 11, or from corner to corner of each bag, would require that the loop material be folded in half to form an upper surface and lower surface. Intermediate the surfaces there is provided two pieces of ½ inch plastic strapping as a stiffening agent. The edges of the folded loop 30 are then stitched together to close folded loop 30 around the strapping. This allows the longer lifting loops 30 to remain upright between attachment points at adjoining walls 11 so that a forklift tine may easily enter the space to lift and transport the bulk bags 10.

This is critical in that it would not therefore require a second person to raise the loops 30 in order of the forklift to stab though the openings. Therefore, when a bag 10 is filled and ready to be moved, the lifting loops 30 would naturally be upright in their position as seen in FIG. 9, and accessible to the tines of the forklift. Even though this particular bag my have a second bag filled and stacked upon it, when the second filled bag is raised off of that bag, the lifting loops because of the stiffener would again raise upright into position and ready for the forklift to stab the bag.

Figure 10:
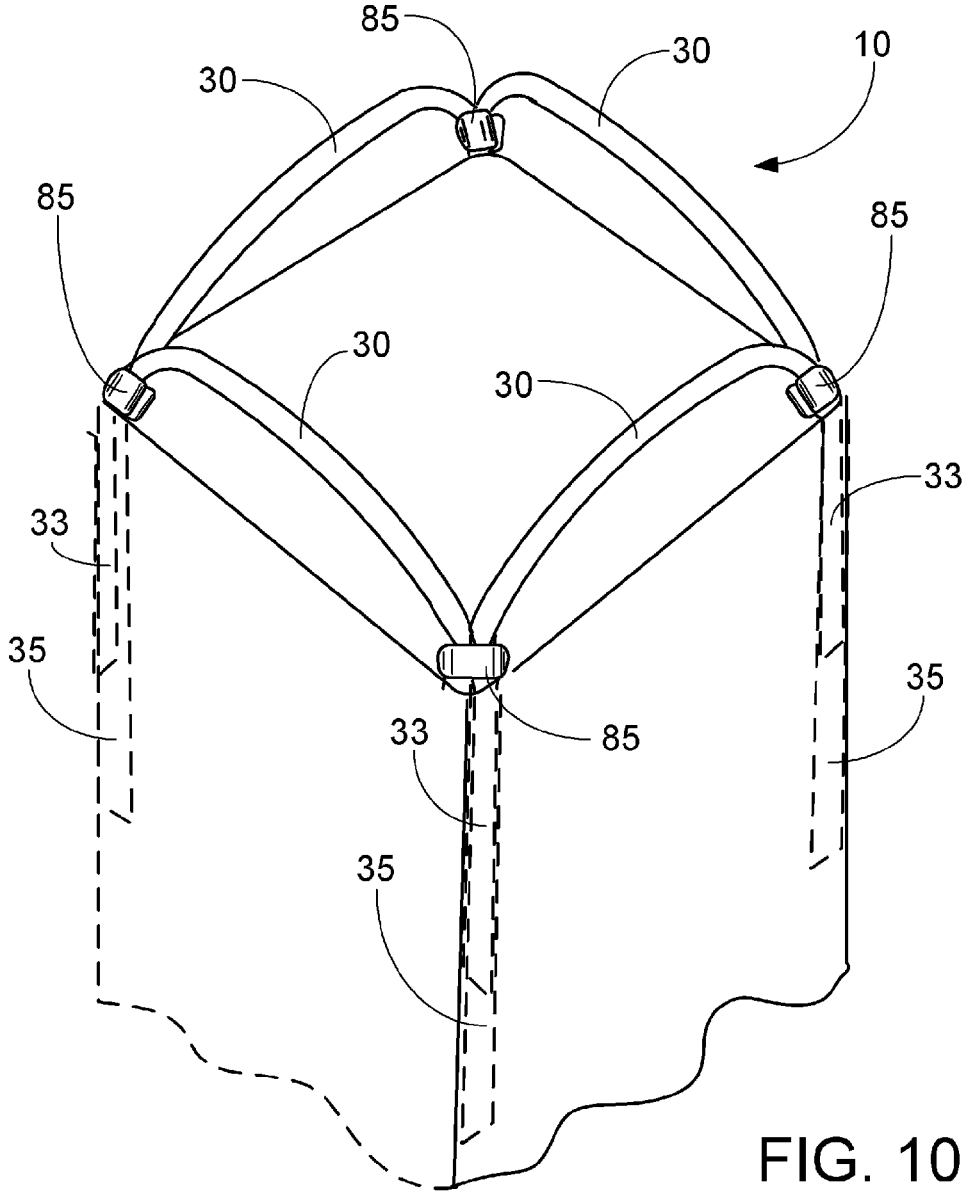
FIG. 10 illustrates an overall view of the attachment points of the lifting loops to the bulk bag as seen in the first principal embodiment.
Figure 11:
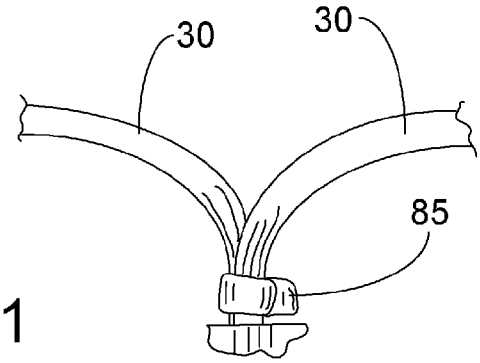
FIG. 11 illustrates an isolated view of the positioning of the safety enforcement ring in the preferred embodiments of the present invention.

Turning now to FIGS. 10 and 11, there is illustrated an additional important feature for both embodiments of the lifting loop arrangement for each of the bags 10. As seen in FIG. 10 again, the ends of the lifting loops span the width of a side wall 11, and are therefore stitched into position as seen in FIG. 10. At the joining point 80 of each of the lifting loop ends 33, 35, there is provided what is termed a safety enforcement ring 85 which is a circular ring of heavy duty fabric encircling the point of juncture 80 of the lifting loops directly above where they are stitched into the adjoining side walls 11 of the bag. Each of these rings 85 are very important in that when a bag is lifted by a forklift, it is critical that the stresses placed on the lifting loops 30 do not pull the loop 30 in such a manner so as to cause a rupture of the seam formed between the edges 32, 34 of the side walls 11 which would compromise the integrity of the stitching along the side walls. The safety ring 85 therefore would take the initial stress from the lifting of the bag 10 and therefore would eliminate stress upon the seams between the side wall 11, which again may be damaging to the bag.

Earlier in the discussion of the present invention, and seen throughout the drawing Figures of the present invention, there can be identified a feature which has been labeled as a "dart" 100. This feature, also known as a stacker seam 100, provides the final feature of both embodiments of the bag 10 which is set in place. The stacker seam 100 would define a dart formed in each of these attachment points at the joining of the edges 32, 34 of each of the side walls 11. Each of these stacker seams 100 formed at each of the attachment points of the four lifting loops 30, and would define a bottleneck feature of the bag 10, which enables the bag to maintain its vertical alignment when filled with material so that other bags may be stacked thereupon. This is fully discussed in the pending application referenced above. There would also be provided a back tack stitching point 54, which prevents spreading forces in the bag when the bags are stacked.

It is through this combination of features of the four lifting loops 30 attached to the central points 38 of the sidewalls and the stacker seam 50 defining the bottleneck feature of the bag which allows these new bags to be easily transported and securely and safely stacked upon one another after transport or storage.

All measurements disclosed herein are at standard temperature and pressure, at sea level on Earth, unless indicated otherwise.

The following is a list of suitable parts and materials for the various elements of the preferred embodiment of the present invention.

PARTS LIST

| Description | Part Number |
|---|---|
| bulk bag | 10 |
| side wall panels | 11 |
| bottom portion | 13 |
| top portion | 15 |
| lifting loop | 18 |
| legs | 20, 21 |
| points | 22 |
| lifting loop opening | 24 |
| corner | 25 |
| vertical seam | 26 |
| lifting loop | 30 |
| leg or end portions | 33, 35 |
| first and second edges | 32, 34 |
| corners | 37 |
| stitching line | 45 |
| tines | 50 |
| openings | 60 |
| centerpoint | 70 |
| arrows | 72 |
| point | 80 |
| safety enforcement ring | 85 |
| dart or stacker seam | 100 |

The foregoing embodiments are presented by way of example only; the scope of the present invention is to be limited only by the following claims.

The invention claimed is:

1. An improved bulk bag construction, comprising:

a. a plurality of vertical sidewall panels, each panel having first and second vertical edges;

b. a plurality of lifting loops, each having a first and second leg portion, wherein the first and second leg portions of each lifting loop have unequal lengths, wherein the first and second leg portions of each lifting loop terminate at a distance from a bottom edge of each of the vertical sidewall panels and wherein the first leg portion of each lifting loop extends from the first vertical edge of each vertical sidewall panel and the second leg portion of each lifting loop extends from the second vertical edge of each sidewall panel;

c. each first vertical edge of the vertical sidewall panels stitched to an adjoining second vertical edge of the sidewall panels forming four sidewalls to define a bulk bag enclosure space wherein the first leg portion of one lifting loop and the second leg portion of an adjacent lifting loop are stitched in between the first vertical edge of one sidewall panel and the second vertical edge of an adjacent sidewall panel to form a single line of stitching;

d. each of the lifting loops terminating at a center point of each of the four sidewalls, when the panels are stitched together and wherein corners of the bag do not have stitch points; and e. a dart formed in the stitch line of each adjoined sidewall panel, so that an upper portion of the bag forms a bottleneck configuration, while each of the first and second leg portions of the lifting loops are stitched into fabric defining the dart.

2. The bulk bag construction in claim 1, further comprising a reinforcement ring engaging the legs of the lifting loops directly above where the lifting loop legs are attached at each stitch line of adjoining panels to define a means to strengthen the attachment point as filled bulk bags are lifted.

3. The bulk bag construction in claim 1, wherein there is provided a bottom of the bag stitched along a bottom edge of each sidewall panel after the panels are stitched together to define the bulk bag space.

4. An improved bulk bag construction, comprising:

a. a plurality of vertical sidewall panels, each panel having first and second vertical edges;

b. a plurality of lifting loops, each having a first and second leg portion, wherein the first and second leg portions of each lifting loop have unequal lengths, wherein the first and second leg portions of each lifting loop terminate at a distance from a bottom edge of each of the vertical sidewall panels and wherein the first leg portion of each lifting loop extends from the first vertical edge of each vertical sidewall panel and the second leg portion of each lifting loop extends from the second vertical edge of each sidewall panel;

c. each first vertical edge of the vertical sidewall panels stitched to an adjoining second vertical edge of the vertical sidewall panels at each corner of the bag forming four sidewalls to define a bulk bag enclosure space wherein the first leg portion of one lifting loop and the second leg portion of an adjacent lifting loop are stitched in between the first vertical edge of one sidewall panel and the second vertical edge of an adjacent sidewall panel to form a single line of stitching; and d. wherein the first leg portion of each lifting loop terminates at one corner of each of the four sidewalls and the second leg portion of each lifting loop terminates at a different corner of each the four sidewalls; and e. wherein a longer leg portion of each lifting loop is stitched to a shorter leg portion of another lifting loop; and f. a dart formed in the stitch line of each adjoined sidewall panel, so that an upper portion of the bag forms a bottleneck configuration, while each of the first and second leg portions of the lifting loops are stitched into fabric defining the dart.

5. The bulk bag construction in claim 4, wherein there is provided a stacker seam on each of the bag corners so as to prevent failure of the bulk bag when filled.

6. An improved bulk bag construction, comprising:

a. a plurality of vertical sidewall panels, each panel having first and second vertical edges;

b. a plurality of lifting loops, each having a first and second leg portion, wherein the first leg portion of each lifting loop extends from the first vertical edge of each vertical sidewall panel and the second leg portion of each lifting loop extends from the second vertical edge of each sidewall panel, wherein the first and second leg portions of each lifting loop have unequal lengths and wherein the first and second leg portions of each lifting loop terminate at a distance from a bottom edge of each of the vertical sidewall panels;

c. each first vertical edge of the vertical sidewall panels stitched to an adjoining second vertical edge of the sidewall panels, forming four sidewalls to define a bulk bag enclosure space, wherein the first leg portion of one lifting loop and the second leg portion of an adjacent lifting loop are stitched in between the first vertical edge of one sidewall panel and the second vertical edge of an adjacent sidewall panel to form a single line of stitching;

d. each of the lifting loops terminating at a center point of each of the four sidewalls, when the panels are stitched together, wherein a longer leg portion of each lifting loop is stitched to a shorter leg portion of another lifting loop; and e. plastic strapping folded into each of the lifting loops to provide for stiffening of the loops between attachment points; and f. a dart formed in the stitch line of each adjoined sidewall panel, so that an upper portion of the bag forms a bottleneck configuration, while each of the first and second leg portions of the lifting loops are stitched into fabric defining the dart.

7. An improved bulk bag construction, comprising:

a. a plurality of vertical sidewall panels, each panel having first and second vertical edges;

b. a plurality of lifting loops, each having a first and second leg portion, wherein the first leg portion of each lifting loop extends from the first vertical edge of each vertical sidewall panel and the second leg portion of each lifting loop extends from the second vertical edge of each sidewall panel, wherein the first and second leg portions of each lifting loop have unequal lengths, and wherein the first and second leg portions of each lifting loop terminate at a distance from a bottom edge of each of the vertical sidewall panels;

c. each first vertical edge of the vertical sidewall panels stitched to an adjoining second vertical edge of the sidewall panels, forming four sidewalls to define a bulk bag enclosure space, wherein the first leg portion of one lifting loop and the second leg portion of an adjacent lifting loop are stitched in between the first vertical edge of one sidewall panel and the second vertical edge of an adjacent sidewall panel to form a single line of stitching;

d. each of the lifting loops terminating at a center point of each of the four sidewalls, when the panels are stitched together; and e. a dart formed in the stitch line of each adjoined sidewall panel, so that the upper portion of the bag forms a bottleneck configuration, while a first leg of lifting loop and a second leg of an adjacent lifting loop are stitched into fabric defining the dart; and f. plastic strapping folded into each of the lifting loops to provide for stiffening of the loops between attachment points; and g. reinforcement rings encircling the legs of the lifting loops directly above where the lifting loop legs are attached to the sidewall panels, and wherein the reinforcement rings are not stitched to the vertical sidewall panels.

8. An improved bulk bag construction, comprising:

a. a plurality of vertical sidewall panels, each panel having first and second vertical edges;

b. a plurality of lifting loops, each having a first and second leg portion, wherein the first leg portion of each lifting loop extends from the first vertical edge of each vertical sidewall panel and the second leg portion of each lifting loop extends from the second vertical edge of each sidewall panel wherein the first and second leg portions of each lifting loop have unequal lengths, wherein the first and second leg portions of each lifting loop terminate at a distance from a bottom edge of each of the vertical sidewall panels and wherein a longer leg portion of one lifting loop is stitched to a shorter leg portion of another lifting loop;

c. each first vertical edge of the vertical sidewall panels stitched to an adjoining second vertical edge of the sidewall panels at each corner of the bag forming four sidewalls to define a bulk bag enclosure space, wherein the first leg portion of one lifting loop and the second leg portion of an adjacent lifting loop are stitched in between the first vertical edge of one sidewall panel and the second vertical edge of an adjacent sidewall panel to form a single line of stitching;

d. each of the lifting loops terminating at the corner of each of the four sidewalls, when the panels are stitched together; and e. a dart formed in the stitch line of each adjoined sidewall panel, so that the upper portion of the bag forms a bottleneck configuration, while each of the legs of the lifting loops are stitched into fabric defining the dart; and f. plastic strapping folded into each of the lifting loops to provide for stiffening of the loops between attachment points.

* * * * *